US007766319B2

(12) United States Patent
Miyamoto et al.

(10) Patent No.: US 7,766,319 B2
(45) Date of Patent: Aug. 3, 2010

(54) RECORDED MEDIUM FEEDING DEVICE AND RECORDING APPARATUS

(75) Inventors: Yuji Miyamoto, Matsumoto (JP); Tsuyoshi Sugiura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 9 days.

(21) Appl. No.: 12/166,685

(22) Filed: Jul. 2, 2008

(65) Prior Publication Data

US 2009/0008865 A1 Jan. 8, 2009

(30) Foreign Application Priority Data

Jul. 4, 2007 (JP) ..... 2007-176238

(51) Int. Cl.
*B65H 3/06* (2006.01)

(52) U.S. Cl. ..... 271/117

(58) Field of Classification Search ..... 271/117, 271/118, 120, 113, 109
See application file for complete search history.

(56) References Cited

U.S. PATENT DOCUMENTS

| | | | | |
|---|---|---|---|---|
| 5,050,854 | A * | 9/1991 | Tajima | 271/122 |
| 6,896,254 | B2 * | 5/2005 | Koh et al. | 271/117 |
| 7,004,460 | B2 * | 2/2006 | Ruhe et al. | 271/113 |
| 7,384,033 | B2 * | 6/2008 | Asada | 271/114 |
| 2004/0188917 | A1 * | 9/2004 | Koh et al. | 271/117 |
| 2005/0179192 | A1 * | 8/2005 | Miura et al. | 271/118 |
| 2005/0194733 | A1 * | 9/2005 | Asada | 271/117 |

FOREIGN PATENT DOCUMENTS

| | | |
|---|---|---|
| JP | 05-056449 | 3/1993 |
| JP | 06-263289 | 9/1994 |
| JP | 08-143184 | 6/1996 |
| JP | 09-202481 | 8/1997 |
| JP | 11-079473 | 3/1999 |
| JP | 2003-072963 | 3/2003 |
| JP | 2003-292198 | 10/2003 |

* cited by examiner

*Primary Examiner*—Kaitlin S Joerger
(74) *Attorney, Agent, or Firm*—Workman Nydegger

(57) ABSTRACT

A recorded medium feeding device includes a pickup roller that feeds recorded medium downstream from a setting position by contacting with the recorded medium and rotating and a separating means for separating recorded medium to be fed and subsequent recorded media from the next page onward. The positions of a nip point of the separating means and a place where the pickup roller contacts the recorded medium in the direction orthogonal to the recorded medium feeding direction with respect to a recorded medium of a predetermined size to be fed by the pickup roller are located within a range deviated to one side from the center of the recorded medium of the predetermined size. A path elongating portion that elongates the feed path length of the recorded medium by abutting the recorded medium is apart from the nip point and the place where the pickup roller contacts the recorded medium.

1 Claim, 7 Drawing Sheets

RECORDED MEDIUM FEEDING DEVICE AND RECORDING APPARATUS

BACKGROUND

1. Technical Field

The present invention relates to a recorded medium feeding device that feeds a recorded medium to a recording unit that carries out recording on the recorded medium and a recording apparatus having the same.

2. Related Art

A feeding roller that feeds paper in the paper feeding device is generally provided at a position deviated toward the side of a reference position (the single-digit side) in the direction of paper width in order to accommodate paper in small sizes. Therefore, when feeding paper in a large size, the feed roller is positioned so as to be deviated toward the single-digit side with respect to the widthwise center position of the paper. However, the curved posture of the paper at a position of the feed roller is different from the curved posture at a position apart from the feed roller, and hence paper skew is resulted. Therefore, in the paper feeding device disclosed in Japanese Patent No. 3775492, an "auxiliary roller" having substantially the same shape as the feed roller when viewing the paper feed path from the side is provided so that the curved posture of paper is uniformized in the direction of paper width.

There is a paper-feeding device of a type which feeds paper from the paper-feed cassette by a pickup roller invert the paper by an intermediate roller provided on the downstream side of the pickup roller and feeds the inverted paper to the recording unit. In the paper feeding device of this type, the pickup roller is provided at a position deviated to the side of the reference position (the single-digit side) in the direction of paper width for accommodating paper in smaller sizes. Therefore, in the paper feeding device in this manner, means for constraining the curved posture of the paper to be uniform in the direction of paper width is preferable in the same manner as described above.

In the paper feeding device of this type, separating means for separating paper on the downstream side of the pickup roller is provided. The separating means separates a piece of paper to be fed and subsequent pieces of paper by forming a nip point between the feed roller and the retard roller.

Since the separating means provides a paper-passage load to the paper, the pickup roller and the separating means are provided at substantially the same position in the direction of paper width. However, the paper to be fed receives the paper-passage load from the separating means, the speed of paper when passing through the separating means is lower than the paper feeding speed by the pickup roller, and hence the paper tends to be skewed between the pickup roller and the separating means as a result.

In other words, in the direction of paper width, the length of the paper path at the position of the pickup roller and the separating means in the direction of paper width is longer than the length of the paper path at a position apart from the pickup roller and the separating means, which may cause the paper skew. Therefore, in the paper feeding device of this type, it is not possible to prevent the paper skew only by providing the "auxiliary roller" which has substantially the same shape as the paper feeding roller when viewing the paper feeding path from the side as described in Japanese Patent No. 3775492.

SUMMARY

An advantage of some aspects of the invention is that occurrence of paper skew in a paper feeding device configured to feed paper by a pickup roller and separate the paper by separating means provided on the downstream side.

According to an aspect of the invention, there is provided a recorded medium feeding device including: a pickup roller that comes into contact with the recorded medium and rotates to feed recorded medium from a setting position toward the downstream side; and a separating means for separating a recorded medium to be fed and subsequent recorded media from the next page onward by forming a nip point for nipping the recorded medium on the downstream side of the pickup roller, in which the positions of the nip point of the separating means and the place where the pickup roller comes into contact with the recorded medium in the direction orthogonal to the recorded medium feeding direction with respect to a recorded medium of a predetermined size to be fed by the pickup roller are located within a range deviated to one side from the center position of the recorded medium of the predetermined size, and a path elongating portion that elongates the feed path length of the recorded medium to a length longer than the feed path length at a place where the pickup roller comes into abutment with the recorded medium by coming into abutment with the recorded medium is provided at a position apart from the nip point of the separating means and the place where the pickup roller comes into contact with the recorded medium toward the other side.

Accordingly, since the path elongating portion is provided at a position apart from the pickup roller in the direction orthogonal to the direction of feeding the recorded medium for extending the feed path length at the position, the difference in feed path length at the position apart from the pickup roller is reduced or is eliminated even when the recorded medium is skewed between the pickup roller and the separating means and the feed path length at the position of the pickup roller is increased, so that the skew of the recorded media is prevented.

Preferably, the path elongating portion is provided on a pivotal member which is able to pivot and rotatably supports the pickup roller.

Accordingly, since the path elongating portion is provided on the pivotal member which is able to pivot and rotatably supports the pickup roller, the structure of configuration that the position to come into contact with the recorded medium is displaced according to the amount of stacked recorded media is simplified at a low cost.

Preferably, the path elongating portion is provided so as to be capable of displacing the position on the pivotal member or so as to be capable of changing its own posture, so that the feed path length is elongated by coming into contact with the recorded medium fed by the pickup roller.

In a case in which the path elongating portion is provided fixedly with respect to the pivotal member, when the posture of the pivotal member is changed according to the stacked amount of recorded media, there arises a case in which the path elongating portion cannot come into contact with the recorded medium and hence the feed path length cannot be elongated. However, according to the aspect of the invention, the path elongating portion is provided not fixedly with respect to the pivotal member so as to be capable of changing the position with respect to the pivotal member, or so as to be capable of changing the posture of its own. Therefore, since the length of the feed path is elongated in a state of being in contact with the recorded medium irrespective of the posture of the pivotal member, the skew of the recorded medium is adequately prevented irrespective of the stacked amount of the recorded medium.

According to another aspect of the invention, there is provided a recording apparatus including a recording unit that carries out recording on the recorded medium, and the recorded medium feeding device as described above that feeds the recorded medium to the recording unit. Accordingly, the same effects and advantages as described above are achieved in the recording apparatus.

According to another aspect of the invention, there is provided a liquid ejecting apparatus including: a pickup roller that feeds ejected medium from a setting position toward the downstream side by coming into contact with the ejected medium and rotating; a separating means for separating a ejected medium to be fed and subsequent ejected media from the next page onward, and a liquid ejecting unit for ejecting liquid to an ejected medium, in which the positions of the nip point of the separating means and the place where the pickup roller comes into contact with the recorded medium in the direction orthogonal to the ejected medium feeding direction with respect to an ejected medium of a predetermined size to be fed by the pickup roller are located within a range deviated to one side from the center position of the ejected medium of the predetermined size, and a path elongating portion that elongates the feed path length of the ejected medium to a length longer than the feed path length at a place where the pickup roller comes into abutment with the ejected medium by coming into abutment with the ejected medium is provided at a position apart from the nip point of the separating means and the position where the pickup roller comes into contact with the ejected medium toward the other side.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
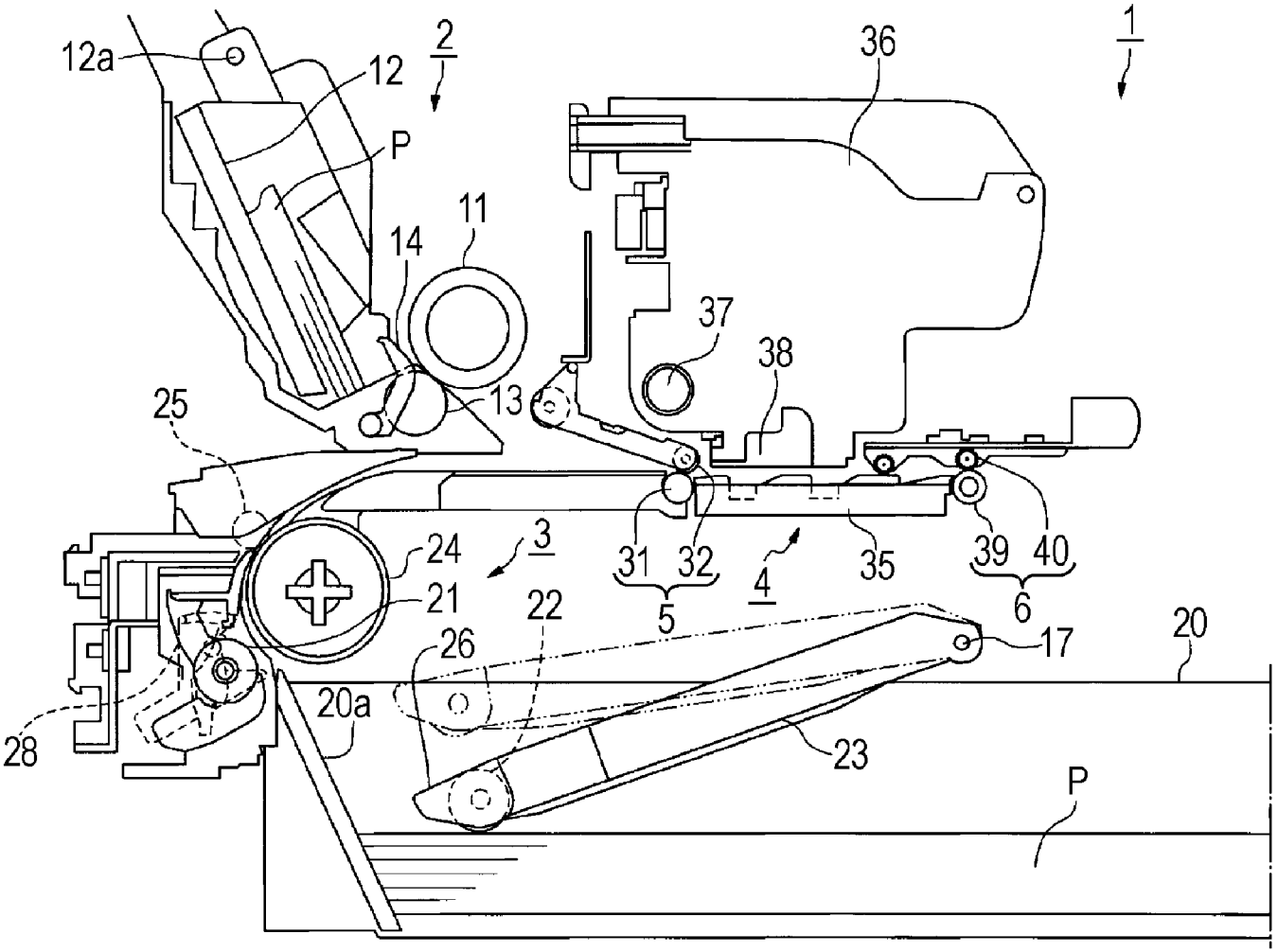
FIG. 1 is a schematic side cross section of a printer according to an embodiment of the invention.
Figure 2:
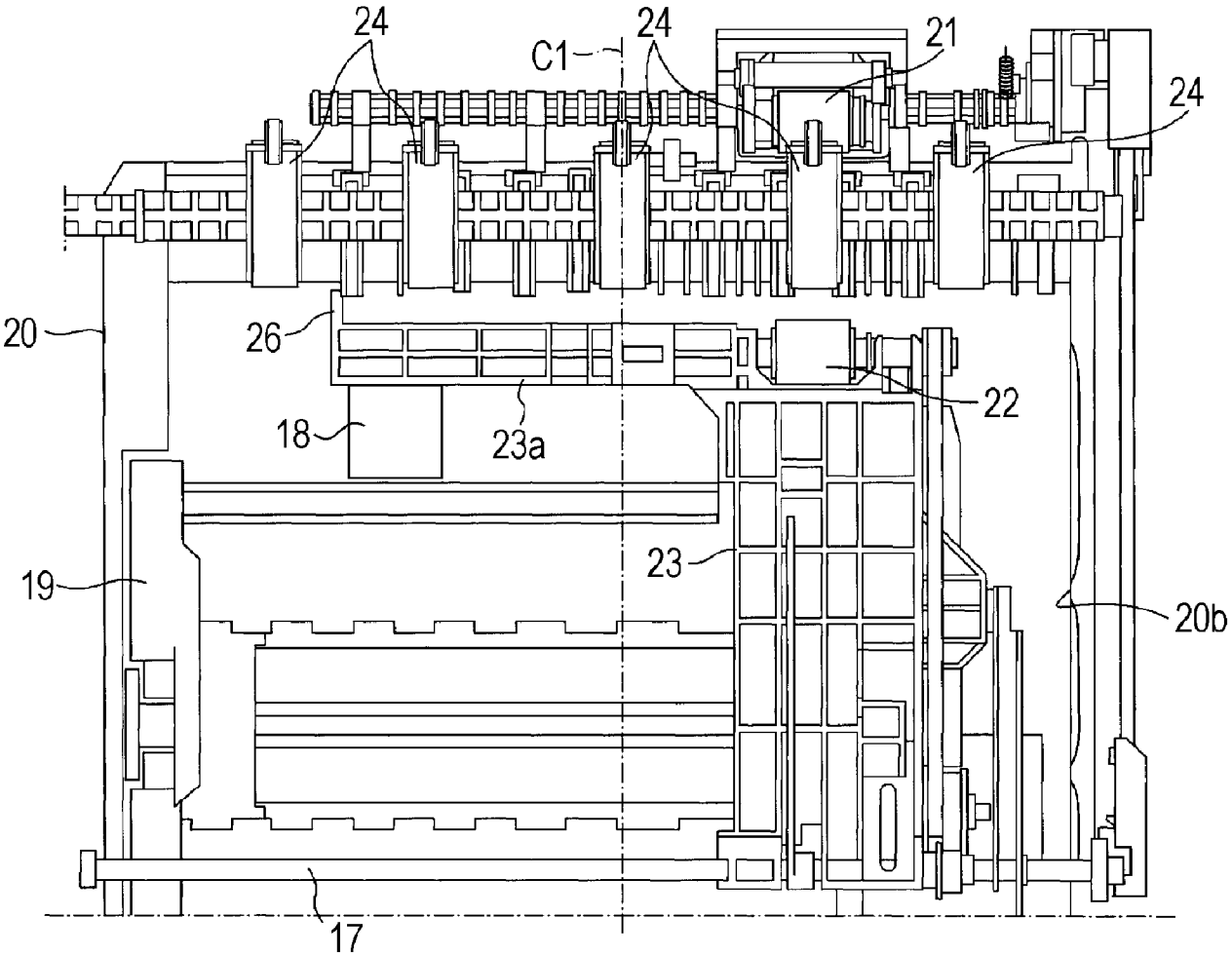
FIG. 2 is a plan view of a principal portion of a feeding device according to the embodiment of the invention.
Figure 3:
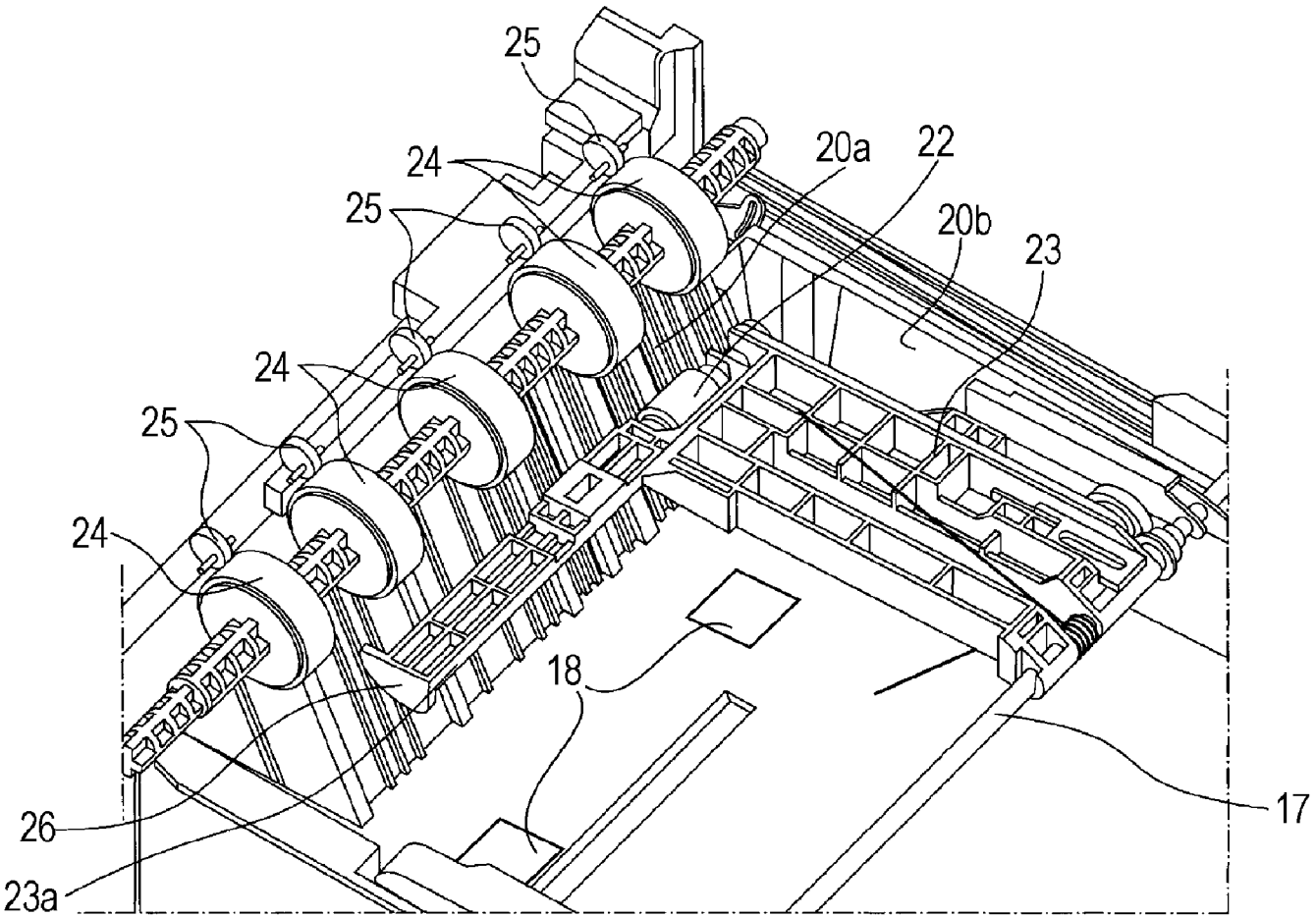
FIG. 3 is a perspective view of the feeding device according to the embodiment of the invention.
Figure 4:
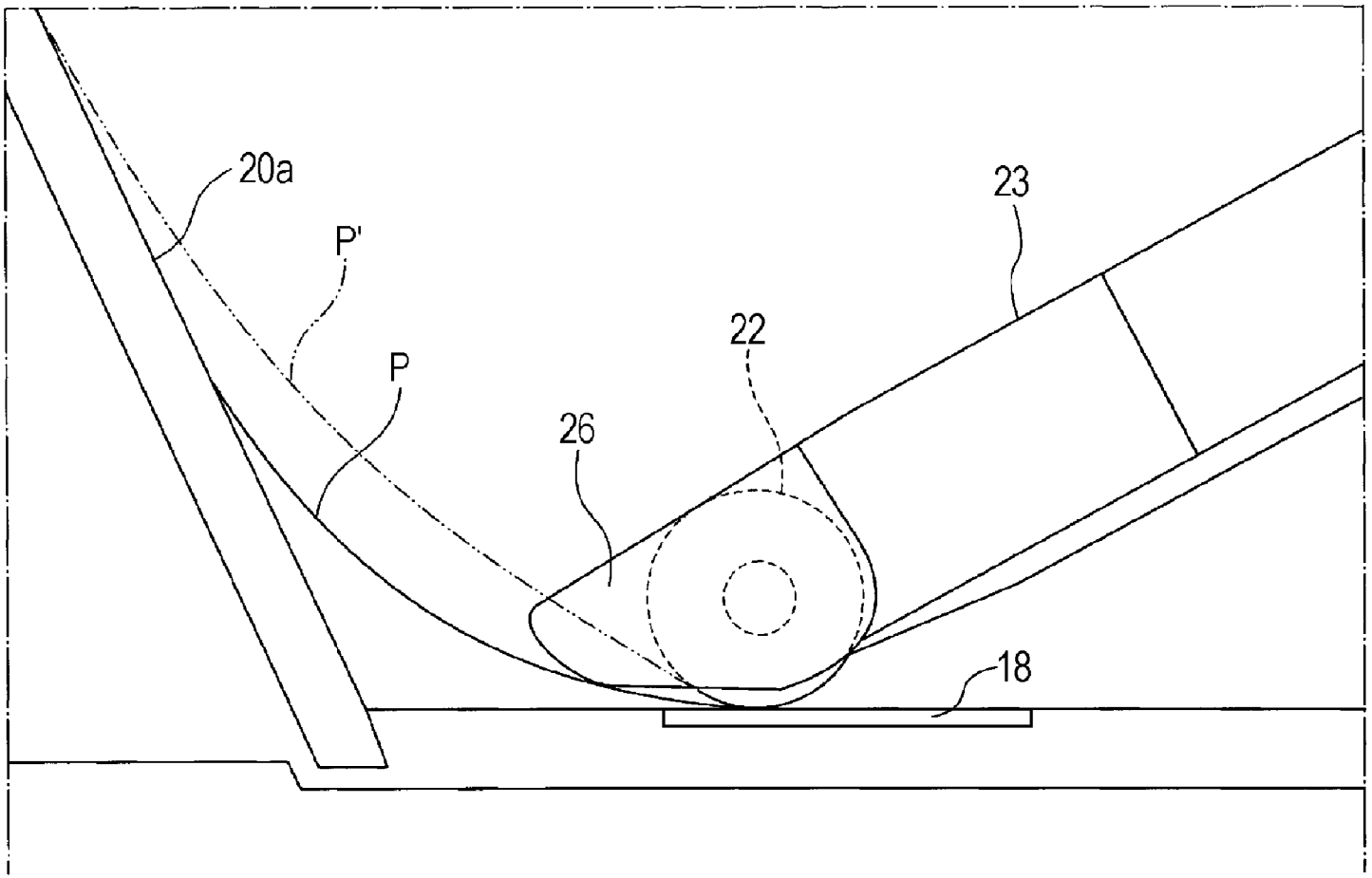
FIG. 4 is a side view of a path elongating portion in the feeding device according to the embodiment of the invention.
Figure 5:
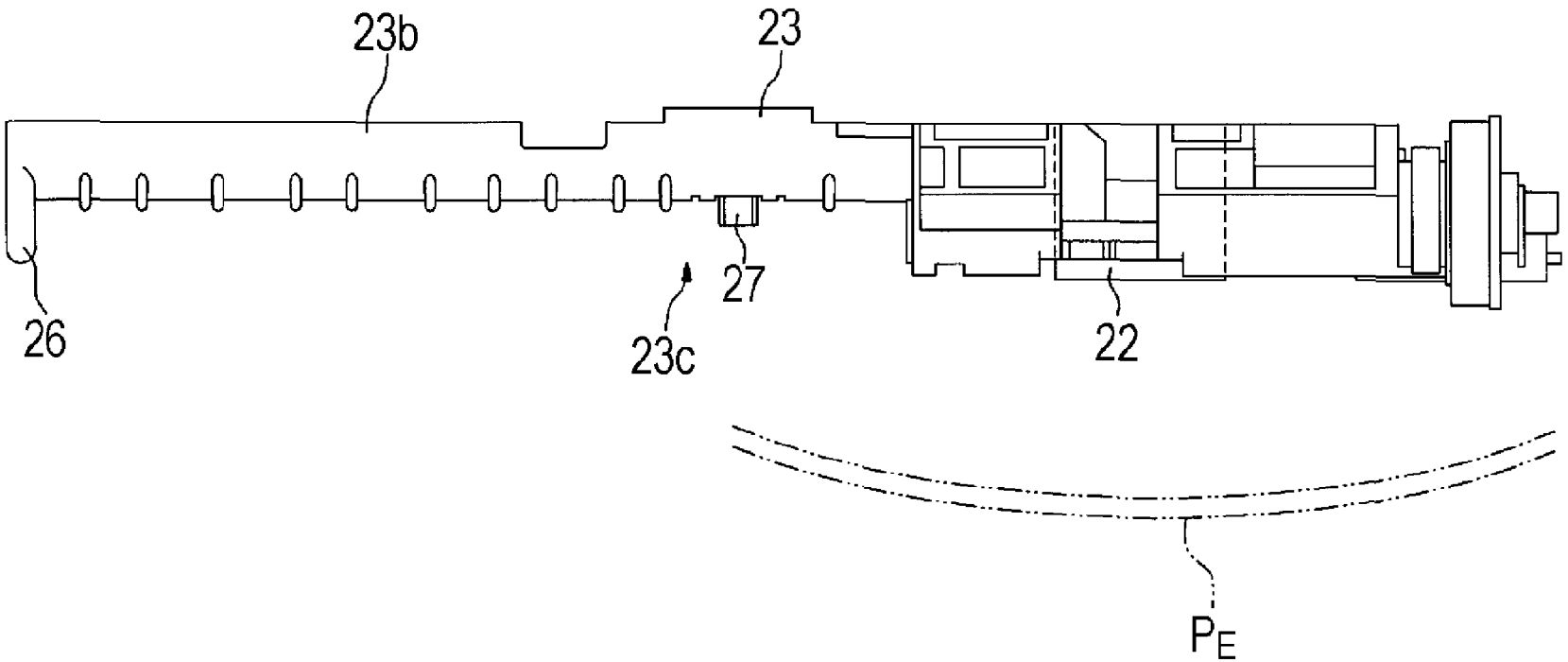
FIG. 5 is a front view of a pivotal member in the feeding device according to the embodiment of the invention.

Referring now to drawings, an embodiment of the invention will be described. FIG. 1 is a schematic side cross-section of an ink jet printer (hereinafter, referred to as "printer") according to an embodiment of a "recording apparatus" or a "liquid ejecting apparatus" according to the invention; FIG. 2 is a plan view of a principal portion of a front feeding device 3; FIG. 3 is a perspective view of the front feeding device 3 in FIG. 2; FIG. 4 is a side view of a path elongating portion 26; and FIG. 5 is a front view of a pivotal member 23.

In the description shown below, a general configuration of the printer 1 will be described in brief on the basis of FIG. 1. The printer 1 includes a rear feeding device 2 as first paper feeding means at a rear portion thereof and a front feeding device 3 according to the invention at a bottom thereof as second paper feeding means, and feeds recording paper (mainly cut paper; hereinafter, referred to as "paper P") as "recorded media" or "ejected media". The paper P is transported to a recording unit 4 by a transport means 5 and is discharged to a stacker, not shown, by discharge means 6.

Components on the paper transport path will be described further in detail.

The rear feeding device 2 includes a hopper 12, a feed roller 11, a retard roller 13 and a paper-return lever 14. The hopper 12 pivots about a pivotal movement support 12*a* at the upper portion thereof to switch between a posture to bring the paper P supported on the hopper 12 in an inclined posture into press contact with the feed roller 11, and a posture to bring the same from the feed roller 11.

The retard roller 13 is provided in a state of being applied with a predetermined rotational resistance, and separates a paper P to be fed at an uppermost position and a subsequent paper P from the next page onward by forming a nip point with the feed roller 11. The paper-return lever 14 is rotatably provided when viewing the paper feeding path from the side, and rotates to return the paper P from the second page onward separated by the retard roller 13.

On the other hand, the front feeding device 3 provided on the bottom portion of the printer 1 and configured to set the paper from the front thereof includes a paper feed cassette 20, a pickup roller 22, intermediate rollers 24, a retard roller 21, a paper return lever 28 and assist rollers 25.

A plurality of pieces of paper P may be set in a stacked state on the paper feed cassette 20 which is capable of mounting and demounting from the front side thereof, and the uppermost one of the set paper P is fed from the paper feed cassette 20 (set position) one by one by the pickup roller 22 driven by the drive motor, not shown. The pickup roller 22 is provided on a pivotal member 23 which pivots about a pivotal movement axis 17, and switches a state of coming into contact with the uppermost paper P and a state of moving apart from the uppermost paper P by a pivotal movement of the pivotal member 23 as shown by a solid line and a virtual line in FIG. 1. A high-friction pad 18 is provided on a bottom surface of the paper feed cassette 20 is (see FIG. 3 and FIG. 4), so that a bundle of paper from the second page onward is prevented from being fed downstream in association with a paper feeding operation by the pickup roller 22.

The paper P to be fed from the set position by the pickup roller 22 is preliminarily separated by moving ahead from a leasing edge thereof toward the downstream side while being in sliding contact with an inclined surface for separation (sliding contact surface) 20*a*, and then moves ahead to the retard roller 21 which constitutes the separating means. The retard roller 21 is provided at a position opposing outer peripheral surfaces of the intermediate rollers 24, and is provided so as to be capable of moving forward and backward with respect to the intermediate rollers 24. When the paper is fed from the paper feed cassette 20, the uppermost paper P to be fed is separated from the paper P from the second level (second page) onward by coming into a press contact with the intermediate rollers 24 and forming a nip point.

The paper return lever 28 is provided so as to be rotatable when viewing the paper feed path, and returns the paper P from the second page onward separated by the retard roller 21 toward the upstream side (paper feed cassette 20).

The intermediate rollers 24 are driven by a drive motor, not shown, incurvates and inverts the paper to be fed, and feeds the same to the transport means 5. The assist rollers 25 come into contact with the intermediate rollers 24 to assist feeding of the paper P by the intermediate roller 24 toward the downstream side.

Subsequently, the transport means 5 provided on the downstream side of the rear feeding device 2 and the front feeding device 3 includes a transport drive roller 31 which rotates by being driven by a motor, and a transport driven roller 32 which is rotated by coming into press contact with the transport drive roller 31. The paper P which reaches the transport means 5 is transported to the recording unit 4 on the downstream side by the rotation of the transport drive roller 31 in a state in which the paper is nipped between the transport drive roller 31 and the transport driven roller 32.

The recording unit 4 includes a recording head 38 for discharging ink toward the paper P and a paper guide front 35 for constraining the distance of the paper P and the recording head 38 by supporting the paper P. The recording head 38 is provided on a bottom portion of the carriage 36, and the carriage 36 is driven so as to reciprocate in the primary scanning direction by the drive motor, not shown while being guided by a carriage guide shaft 37 extending in the primary scanning direction (the direction through the front and back surfaces of the paper of the drawing). The carriage 36 includes ink cartridges (not shown) independent for a plurality of colors, so that ink is supplied from the ink cartridges to the recording head 38.

Subsequently, the discharge means 6 for discharging the paper P after having printed thereon on the downstream side of the recording unit 4. The discharge means 6 includes a discharge drive roller 39 rotated by being driven by a motor, not shown and a discharge driven roller 40 that rotates by being driven by coming into contact with the discharge drive roller 39. The paper P after having recorded by the recording unit 4 is discharged onto a stacker, not shown, provided on the front side of the apparatus by the discharge drive roller 39 which rotates by being driven in a state in which the paper P is nipped between the discharge drive roller 39 and the discharge driven roller 40.

The printer 1 has been briefly described thus far. Referring now to FIG. 2 and FIG. 5, the front feeding device 3 will be described further in detail.

The paper feed cassette 20 is provided with a movable edge guide 19 so as to be displaceable in the direction of paper width (lateral direction in FIG. 2), and constrains side edges of the paper set in the paper feed cassette 20 together with an inner wall surface 20*b* in the interior of the paper feed cassette 20. The inclined surface for separation 20*a* is formed at apposition opposing the leading edge of the paper set in the paper feed cassette 20, and the paper fed from the set position by the pickup roller 22 moves ahead while being in sliding contact at the leading edge thereof with the inclined surface for separation 20*a*, thereby being separated preliminarily from the paper from the second page onward.

The pickup roller 22 and the retard roller 21 are provided in an area deviated from the center position of a paper storage area of the paper feed cassette 20 (the position indicated by a reference sign C1) to the one side (one-digit side (the side of the reference position): right side in FIG. 2) in the direction orthogonal to the paper feed direction (the lateral direction in FIG. 2; hereinafter, referred to as "direction of the paper width).

In other words, the pickup roller 22 and the retard roller 21 are positioned at places deviated from the widthwise center position to the single-digit side for relatively large sized paper (for example, A4 paper) from among various sizes of paper which can be set in the paper feed cassette 20.

In contrast, the pickup roller 22 and the retard roller 21 are positioned at places deviated from the widthwise center position to the 80-digit side (left side in FIG. 2) for relatively small sized paper (for example, post-card sized paper). Depending on the size, the pickup roller 22 and the retard roller 21 are positioned at the widthwise center position. In this embodiment, the positions of the pickup roller 22 and the retard roller 21 in the direction of the paper width are the same.

Subsequently, the pickup roller 22 is provided on the pivotal member 23 formed substantially into an L-shape which is pivotal about the pivotal movement axis 17. The pivotal member 23 is integrally provided with an arm portion 23*a* extending in the direction of paper width by resin material, and the arm portion 23*a* is positioned above a position where the pickup roller 22 comes into contact with the paper in plan view as shown in FIG. 5, thereby forming a shoulder 23*c*.

With the provision of the shoulder 23*c*, even when the paper assumes a curled so as to project downward in the stacked state as shown by a reference sign $P_E$, the side portion of the paper is released to the pivotal member 23*c*, so that a contact of the pickup roller 22 with the stacked paper is ensured. The shoulder 23*c* is provide with a roller 27, so that the side end of the paper comes into contact with the roller 27 so that smooth feeding of the paper is achieved.

A path elongating portion 26 is integrally formed with the arm portion 23*a* at the distal end of the arm portion 23*a*. The path elongating portion 26 is arranged at a position apart from the positions of the pickup roller 22 and the retard roller 21 toward the other side (the 80 digit side; left side in FIG. 2) in the direction of the width as shown in FIG. 2, and has a shape projecting in the paper feeding direction with respect to the pickup roller 22 when viewing the paper feed path from the side as shown in FIG. 4.

As shown in FIG. 4, a reference sign P (solid line) shows a posture of a paper (paper feed path) at the position of the path elongating portion 26, and as apparent from the comparison with the posture of the paper (paper feed path) indicated by the reference sign P' (virtual line), the length of the paper feed path at the position of the path elongating portion 26 is elongated by the provision of the path elongating portion 26.

Accordingly, the following effects and advantages are achieved. That is, since the paper to be fed receives a load when passing through the nip point between the retard roller 21 and the intermediate rollers 24, when comparing the speed of paper when passing through the retard roller 21 and the paper feeding speed by the pickup roller 22, the former is lower, and the paper to be fed is bent between the pickup roller and the retard roller 21 as if it is pressed against the inclined surface for separation 20*a*. In other words, the paper feed length at the positions of the pickup roller 22 and the retard roller 21 is elongated by the paper separation by the retard roller 21 and the intermediate rollers 24.

Therefore, by the provision of the path extending portion 26, the difference between the paper path length at a position apart from the pickup roller 22 and the retard roller 21 and the paper path length at positions of the both rollers is reduced, or the path difference is eliminated, so that the paper skew is prevented.

Figure 6:
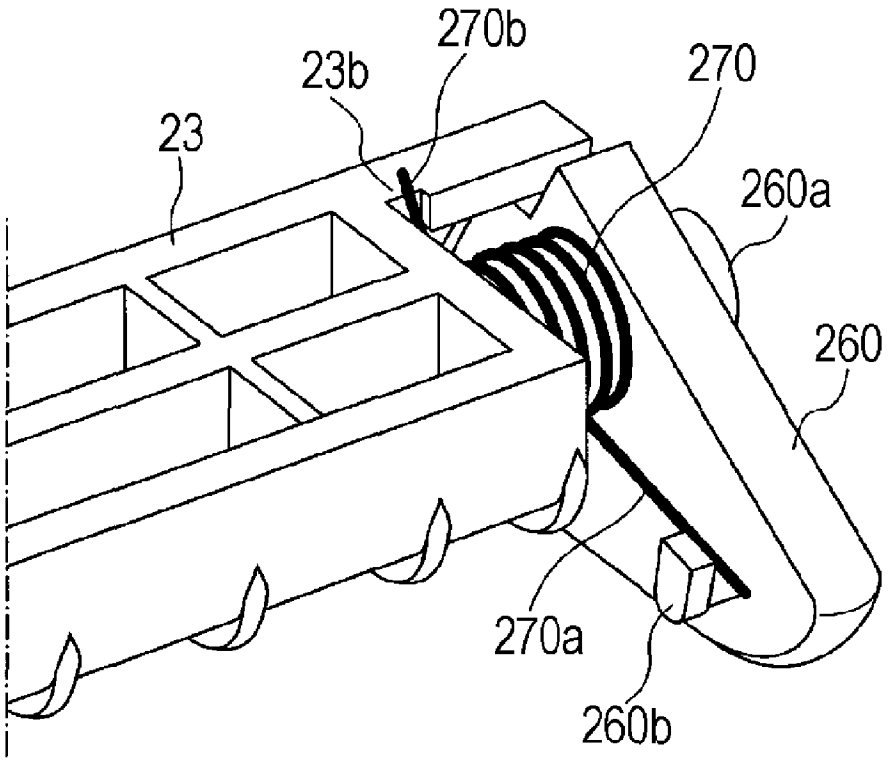
FIG. 6 is a perspective view of the path elongating portion according to another embodiment.
Figure 7:
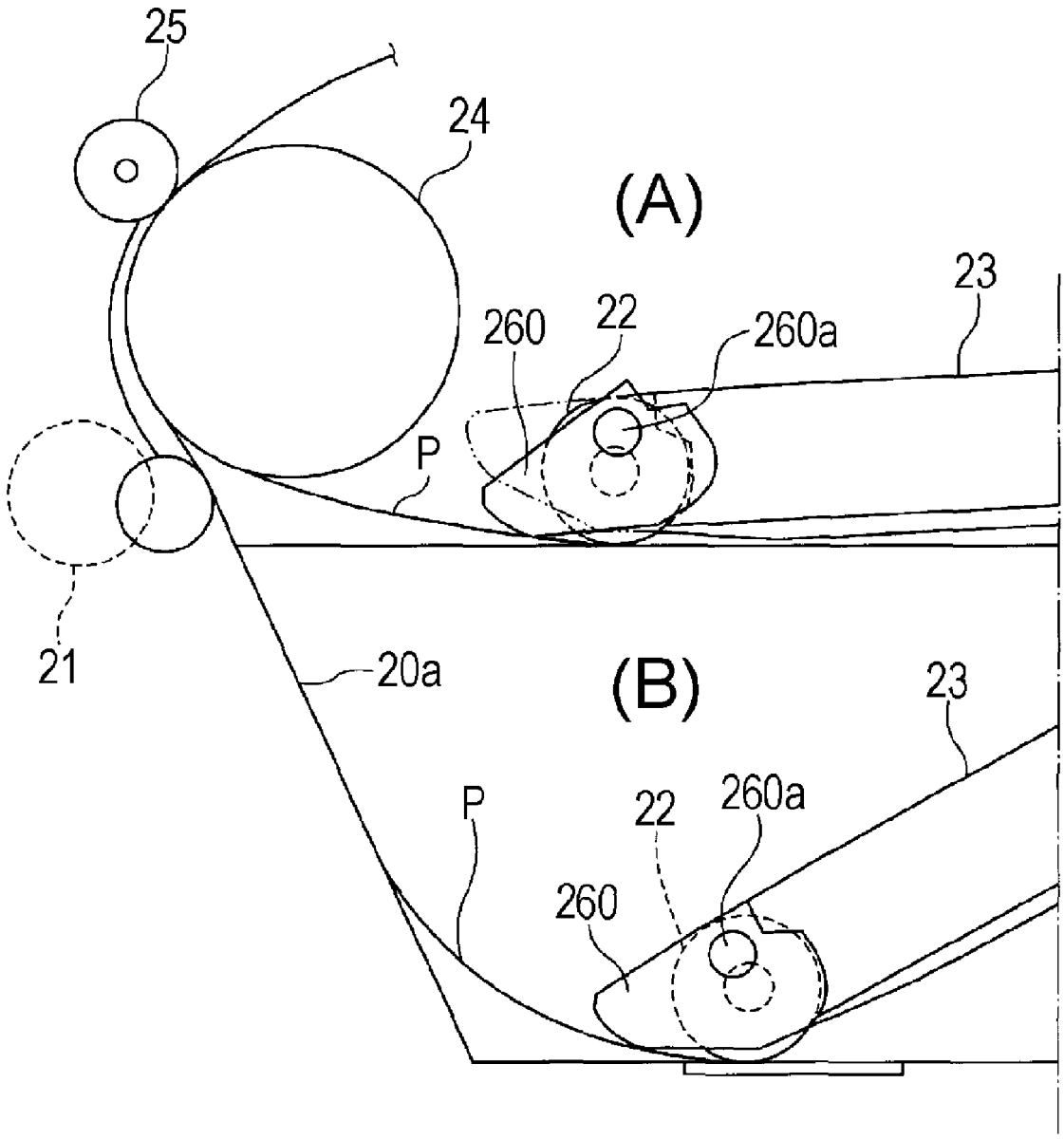
FIG. 7 is a side view of the path elongating portion according to another embodiment of the invention.

Subsequently, referring to FIG. 6 and FIG. 7, another embodiment will be described. FIG. 6 is a perspective view of a path elongating portion 260 according to another embodiment. FIG. 7 is a side view thereof.

The path elongating portion 260 is provided so as to be capable of changing the posture of the pivotal member 23, so that the feeding path is elongated by coming into contact with the paper which is fed by the pickup roller 22 irrespective of the posture of the pivotal member 23.

More specifically, the path elongating portion 260 is provided so as to be capable of pivoting about a pivotal shaft 260*a* when viewing the feed path from the side. A coil spring 270 is inserted into the pivotal shaft 260*a*, one end 270*a* of the coil spring 270 is hooked on a spring hooking portion 260*b* formed on the path elongating portion 260, and the other end

260 of the pivotal member 23, and the other end 270*b* is hooked on the spring hooking portion 23*b* of the pivotal member 23, so that the distal end of the path elongating portion 260 is urged toward the paper.

In FIG. 7, a state in which the amount of stacked paper is large (the state in which the maximum amount of paper is stacked) is shown by (A) and a state in which the amount of stacked paper is small (the state in which the minimum amount of paper (one) is stacked) is shown by (B) and both states are drawn in the same drawing for easy comparison.

In the state (B) in FIG. 7 in which the amount of stacked paper is small, since the angle between the set paper and the pivotal member 23 is relatively steep, the path elongating portion 260 comes into contact with the paper in the state of being pivoted clockwise in the drawing against the urging force of the coil spring 270.

Assuming that the path elongating portion 260 is fixedly provided with respect to the pivotal member 23 so as not to change in posture and keep the state of (B) in FIG. 7, when the amount of stacked paper is increased, the angle formed between the set paper and the pivotal member 23 is relatively gentle as shown by a virtual line in (A), so that the distal end of the path elongating portion 260 cannot come into contact with the paper between the intermediate rollers 24 and the pickup roller 22 and hence the feed path length cannot be elongated.

However, since the path elongating portion 260 is provided on the pivotal member 23 so as to be capable of changing in posture, the path elongating portion 260 comes into contact with the paper fed by the pickup roller 22 and elongates the feed path as shown by a solid line in (A) in FIG. 7. Therefore, the paper skew may be prevented adequately irrespective of the amount of stacked paper.

In the embodiment shown above, the path elongating portion 260 is provided on the pivotal member 23 so as to be capable of pivoting with respect to the pivotal member 23, that is, so as to be capable of changing in posture, so that the path elongating portion 260 comes into contact with the paper fed by the pickup roller 22 and elongates the feed path length. However, it is also possible to provide the path elongating portion 260 in such a manner that the position with respect to the pivotal member 23 is displaceable so that the path elongating portion 260 comes into contact with the paper fed by the pickup roller 22 and elongate the feed path length. For example, by providing the path elongating portion 260 so as to be displaceable in the vertical direction in FIG. 7 and urging the same in the direction to come into contact with the paper, the path elongating portion 260 is able to come into contact with the paper fed by the pickup roller 22 irrespective of the posture of the pivotal member 23.

What is claimed is:

1. A recorded medium feeding device comprising:

a pickup roller that comes into contact with the recorded medium and rotates to feed recorded medium from a setting position toward a downstream side in the transportation direction, the pickup roller being installed at a position that is biased towards a standard position side in a width direction of the recorded medium;

a roller holder having a first end and a second end each of which extends in the width direction of the recorded medium, the first end and second end being separated by an arm portion which extends in the width direction of the recorded medium, the roller holder holding the pickup roller at the downstream end of the roller holder, and the roller holder pivoting around an upstream end of the roller holder, wherein the distance between the second end of the roller holder and a center of the pickup roller in the width direction is smaller than the distance between the first end of the roller holder and the center of the pickup roller in the width direction, and wherein the first end of the roller holder has a projection formed on one end of the arm portion which projects further towards the downstream side in the transportation direction than the pickup roller, the projection also being capable of pivoting with respect to the roller holder and the pickup roller.

* * * * *